US008123219B2

(12) United States Patent
Baba

(10) Patent No.: US 8,123,219 B2
(45) Date of Patent: Feb. 28, 2012

(54) MEDIUM FEEDING DEVICE AND GUIDE MEMBER

(75) Inventor: Emiko Baba, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/264,934

(22) Filed: Nov. 5, 2008

(65) Prior Publication Data

US 2009/0108519 A1 Apr. 30, 2009

Related U.S. Application Data

(62) Division of application No. 10/926,747, filed on Aug. 26, 2004, now Pat. No. 7,458,575.

(51) Int. Cl.
*B65H 5/00* (2006.01)

(52) U.S. Cl. ..... 271/264

(58) Field of Classification Search ..... 271/264
See application file for complete search history.

(56) References Cited

U.S. PATENT DOCUMENTS

| | | | | | |
|---|---|---|---|---|---|
| 2,783,043 | A | * | 2/1957 | Tomlin | 271/188 |
| 3,777,334 | A | * | 12/1973 | Countryman | 24/16 PB |
| 4,842,262 | A | | 6/1989 | Carrish | |
| 5,000,438 | A | * | 3/1991 | Sardano et al. | 271/264 |
| 5,009,410 | A | | 4/1991 | Fujii et al. | |
| 5,342,165 | A | * | 8/1994 | Graef et al. | 271/264 |
| 5,456,456 | A | | 10/1995 | Abe et al. | |
| 5,904,350 | A | | 5/1999 | Creighton et al. | |
| 6,202,260 | B1 | | 3/2001 | Clune et al. | |
| 6,241,245 | B1 | * | 6/2001 | Hollar et al. | 271/264 |
| 6,245,263 | B1 | * | 6/2001 | Yoshizaki et al. | 264/45.5 |
| 6,293,541 | B1 | * | 9/2001 | Horiuchi et al. | 271/272 |
| 6,581,928 | B1 | * | 6/2003 | Stephan | 271/209 |
| 7,624,982 | B2 | * | 12/2009 | Christl et al. | 271/303 |
| 2001/0033051 | A1 | * | 10/2001 | Glanzmann | 271/264 |
| 2004/0041334 | A1 | | 3/2004 | Yoshihara | |
| 2005/0196216 | A1 | * | 9/2005 | Tanahashi et al. | 271/109 |
| 2007/0152398 | A1 | * | 7/2007 | Watanabe | 271/264 |
| 2009/0121422 | A1 | * | 5/2009 | Imoto | 271/264 |
| 2009/0220287 | A1 | * | 9/2009 | Okano et al. | 399/322 |

FOREIGN PATENT DOCUMENTS

| | | | | |
|---|---|---|---|---|
| JP | 4-323123 | A | | 11/1992 |
| JP | 05131483 | A | * | 5/1993 |
| JP | 5-319663 | A | | 12/1993 |
| JP | 05319663 | A | * | 12/1993 |
| JP | 07-76437 | A | | 3/1995 |
| JP | 10-077149 | A | | 3/1998 |
| JP | 2001-239841 | A | | 9/2001 |
| WO | WO 2004061787 | A2 | * | 7/2004 |

* cited by examiner

*Primary Examiner* — Gerald McClain
(74) *Attorney, Agent, or Firm* — Panitch Schwarze Belisario & Nadel LLP

(57) ABSTRACT

A medium feeding device includes a rib disposed on a feeding path along which the medium is fed. In a cross section perpendicular to a direction in which the medium is fed along the feeding path, an end side of the rib includes an end portion that guides the medium, and an inclined portion inclined from the end portion.

11 Claims, 8 Drawing Sheets

MEDIUM FEEDING DEVICE AND GUIDE MEMBER

CROSS-REFERENCE TO RELATED APPLICATIONS

This application is a Divisional of U.S. patent application Ser. No. 10/926,747, filed Aug. 26, 2004, and the disclosure of which is incorporated herein by reference.

BACKGROUND OF THE INVENTION

This invention relates to a medium feeding device for feeding a medium such as a recording paper, and particularly to a medium feeding device having ribs on a feeding path of the medium. This invention also relates to a guide member including the ribs, and a manufacturing method of the guide member.

A medium feeding device has ribs for guiding a medium along a medium feeding path, as disclosed in Japanese Kokai Patent Publication No. HEI 10-77149. Conventionally, the ribs are formed by injection molding process as is the case with a general plastic product with ribs. In the injection molding process, a molten resin is injected into a mold having cavities formed by electric discharge machining.

However, in order to form high ribs, it is necessary to form deep cavities in the mold. Therefore, the time required for machining the mold becomes long, and the finishing and polishing operation of the mold becomes difficult. Moreover, when the resin is injected in the mold, air (or other gas generated in the mold) may remain in the tips of the cavities. In such a case, the resin may not sufficiently be filled in the cavities, and therefore the defective molding may occur.

BRIEF SUMMARY OF THE INVENTION

An object of the present invention is to prevent the defective molding of ribs and to simplify the machining operation of a mold.

The present invention provides a medium feeding device including a rib disposed on a feeding path along which the medium is fed. In a cross section perpendicular to a direction in which the medium is fed along the feeding path, an end side of the rib includes an end portion that guides the medium, and an inclined portion inclined from the end portion.

The present invention also provides a medium feeding device including a rib disposed on a feeding path along which a medium is fed. In a cross section perpendicular to a direction in which the medium is fed along the feeding path, an end side of the rib includes a convex portion whose apex guides the medium, and a step portion adjacent to the convex portion. A level difference is formed between the step portion and the apex.

The present invention also provides a method for manufacturing a guide member provided in a medium feeding device. The guide member has a rib on a feeding path along which a medium is fed. The method includes the steps of preparing a mold which can split into a plurality of components at a parting surface aligned with a position in the vicinity of an end side of the rib, and injecting resin into the mold to form the guide member.

According to the present invention, in the injection molding process, the air (or other gas generated in the mold) escapes outside through the gap formed at the parting surface of the mold. Thus, the resin can sufficiently be filled in the cavity of the mold. As a result, the defective molding can be prevented, even if the rib is high. Moreover, the machining (finishing, polishing or the like) of the mold can be performed in a state where the mold splits into the components, and therefore the machining operation can be simplified.

Further, according to the present invention, the end side of the rib has the end portion and the inclined portion (or, the convex portion and the step portion), and therefore the parting surface can be aligned with the end of the inclined portion (or, the step portion and the like). As a result, even if a burr is formed on the rib, it is possible to prevent the rib from reaching the feeding path, with the result that a de-burring operation can be eliminated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

First Embodiment

Figure 1:
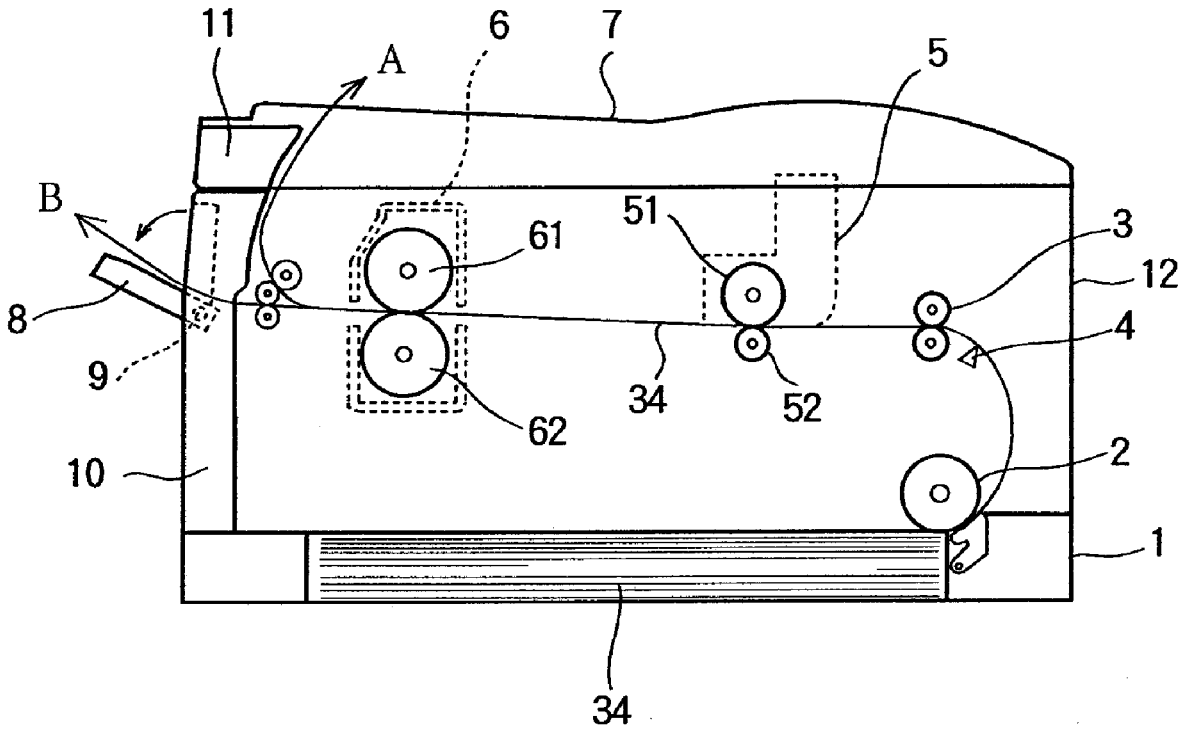
FIG. 1 is a side view of an image forming apparatus in which a medium feeding device according to the first embodiment of the present invention is employed.

FIG. 1 is a side view of an image forming apparatus in which a medium feeding device according to the first embodiment is employed. The image forming apparatus is a printer using an electrophotographic technology. The image forming apparatus includes a cassette 1 accommodating a stack of media (for example, recording papers) 34, a pickup roller 2 for picking up the medium 34 in the cassette 1, a feeding roller 3 for feeding the medium 34 from the pickup roller 2, an image forming unit 5 for transferring a toner image to the medium 34, and a fixing unit 6 for fixing the toner image on the medium 34. These components are accommodated in a housing 12.

The image forming unit 5 includes a photosensitive drum 51 for carrying a toner image. A charging device, an exposing device, a developing device (not shown) and a transfer roller 52 are arranged along a circumference of the photosensitive drum 51. The medium 34 is fed through between the photosensitive drum 51 and the transfer roller 52. The fixing unit 6 includes a heat roller 61 and a pressure roller 62. The medium 34 is fed through between the heat roller 61 and the pressure roller 62. At the upstream side of the feeding roller 3, a medium detection sensor 4 is provided for detecting the passage of the medium 34.

At the downstream side of the fixing unit 6, a swingable eject tray 8 is provided. The eject tray 8 is swingable about a support shaft 9 between a face-down position (shown by a dashed line) and a face-up position (shown by a solid line). The eject tray 8 guides the medium 34 from the fixing unit 6 to the exterior of the housing 12 through the left side of the housing 12 in FIG. 1, when the eject tray 8 is at the face-up position. Further, a first guide member 10 is provided on the housing 12 so as to form the left side wall of the housing 12 in FIG. 1. The first guide member 10 guides the medium 34 from the fixing unit 6 upward. A top cover 7 is provided on the top of the housing 12. A second guide member 11 is provided on the top cover 7 so that the second guide member 11 is disposed at the upper side of the first guide member 10. The second guide member 11 guides the medium 34 from the first guide member 10 further upward.

In the image forming apparatus, the medium 34 is picked up by the pickup roller 2 and fed by the feeding roller 3 toward the image forming unit 5. In the image forming unit 5, the toner image is transferred from the photosensitive drum 51 to the medium 34 by the transfer roller 52. By the rotation of the transfer roller 52, the medium 34 is fed to the fixing unit 6. In the fixing unit 6, the heat roller 61 and the pressure roller 62 apply heat and pressure to the medium 34, so that the toner image is fixed to the medium 34. When the eject tray 8 is at the face-down position, the medium 34 that has passed the fixing unit 6 is guided upward by the first and second guide members 10 and 11, and ejected through a not shown opening formed on the top cover 7 as indicated by an arrow A. When the eject tray 8 is at the face-up position, the medium 34 that has passed the fixing unit 6 is fed through an opening 10*a* (FIG. 2B) of the first guide member 10 and guided by the eject tray 8 to the exterior of the housing 12 as indicated by an arrow B, and laid on the eject tray 8.

In the image forming apparatus shown in FIG. 1, the medium feeding device is constituted by the eject tray 8, the first guide member 10, the second guide member 11 and the mechanism for feeding the medium 34 such as the pickup roller 2 and the feeding roller 3.

Figure 2A:
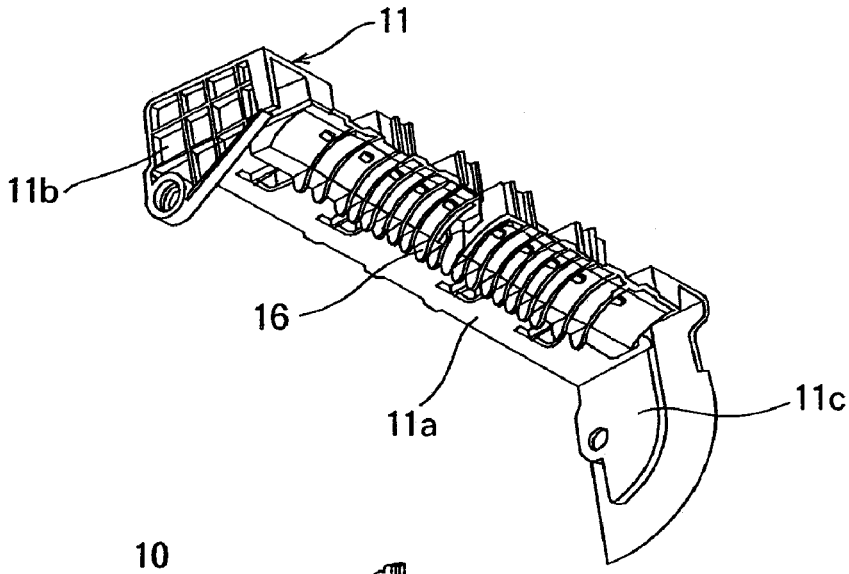
FIGS. 2A, 2B and 2C are perspective views of a second guide member, a first guide member, and an eject tray in the medium feeding device according to the first embodiment.
Figure 2B:
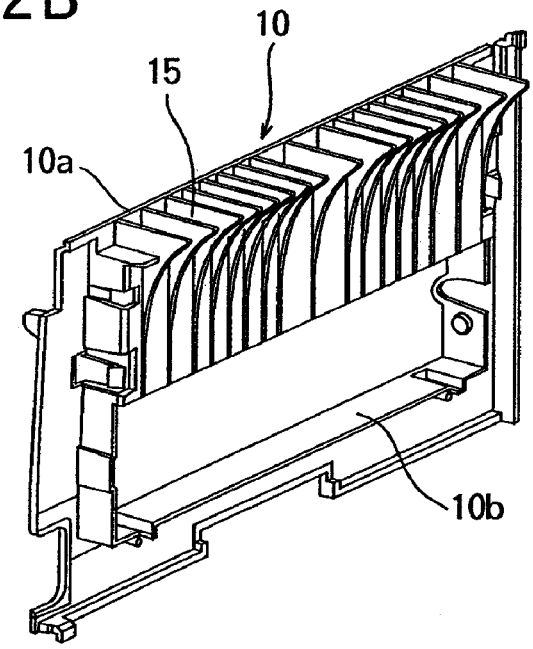
Figure 2C:
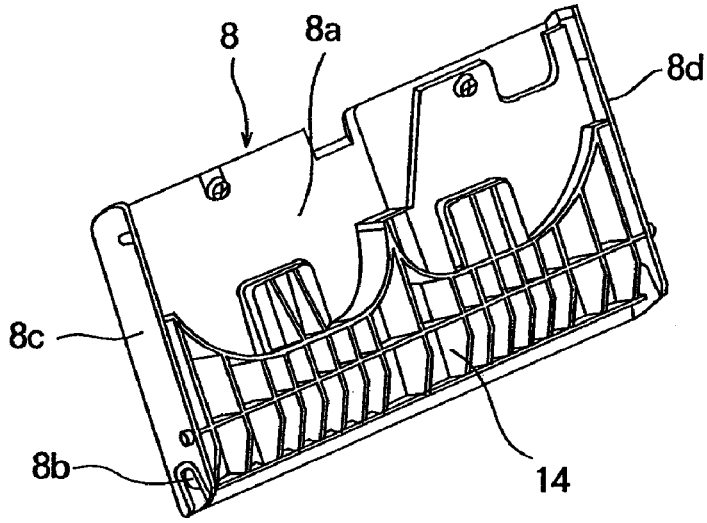

FIGS. 2A, 2B and 2C are perspective views respectively of the second guide member 11, the first guide member 10 and the eject tray 8. As shown in FIG. 2A, the second guide member 11 has a base portion 11*a* elongated in the width direction of the medium 34. The second guide member 11 has a pair of side plate portions 11*b* and 11*c* on both ends of the base portion 11*a* in the longitudinal direction thereof. The side plate portions 11*b* and 11*c* are supported on both side walls of the top cover 7. A plurality of ribs 16 are formed on the base portion 11*a*. The ribs 16 are arranged in the longitudinal direction of the base portion 11*a*, i.e., the width direction of the medium 34. Further, each rib 16 is elongated in the width direction of the base portion 11*a*.

As shown in FIG. 2B, the first guide member 10 has a base portion 10*a* elongated in the width direction of the medium 34. The base portion 10*a* constitutes a side wall of the housing 12. An opening 10*b* is formed at the lower part of the base portion 10*a*. A plurality of ribs 16 are formed on the base portion 10*a*, and are disposed on the upper part of the opening 10*b*. The ribs 15 are arranged in the longitudinal direction of the base portion 10*a*, i.e., the width direction of the medium 34. Further, each rib 15 is elongated in the width direction of the base portion 10*a*.

As shown in FIG. 2C, the eject tray 8 has a base portion 8*a* elongated in the width direction of the medium 34. The eject tray 8 has a pair of side plate portions 8*c* and 8*d* on both ends of the base portion 8*a* in the longitudinal direction thereof. Each of the side plate portions 8*c* and 8*d* has an engaging portion 8*b* that engages the support shaft 9 (FIG. 1). A plurality of ribs 14 are formed on the base portion 8*a*. The ribs 14 are arranged in the longitudinal direction of the base portion 8*a*, i.e., the width direction of the medium 34. Further, each rib 14 is elongated in the width direction of the base portion 8*a*.

Figure 3:
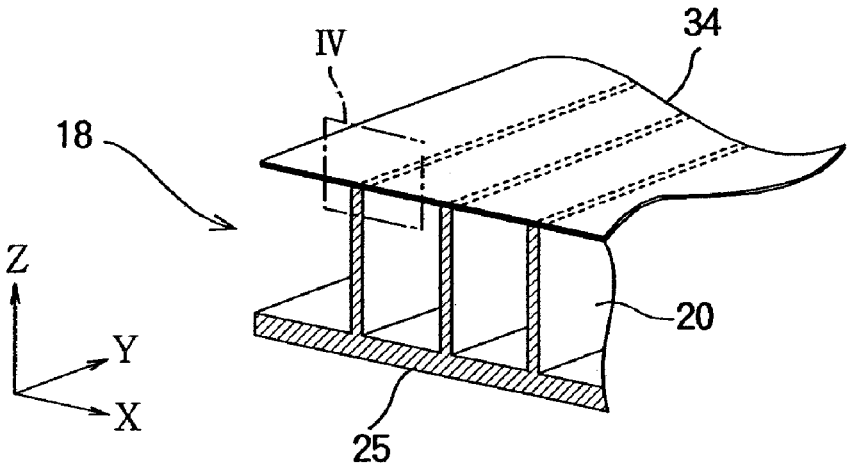
FIG. 3 is a perspective view of a medium feeding path according to the first embodiment of the present invention.

FIG. 3 is an enlarged perspective view illustrating the structure for guiding the medium 34. Hereinafter, the eject tray 8 (FIG. 2C), the first guide member 10 (FIG. 2B) and the second guide member 11 (FIG. 2A) are described as "a guide member 18" as shown in FIG. 3. The respective ribs 14 (FIG. 2C), 15 (FIG. 2B) and 16 (FIG. 2A) are described as "ribs 20" as shown in FIG. 3. The respective base portions 8*a* (FIG. 2C), 10*a* (FIG. 2B) and 11*a* (FIG. 2A) are described as "a base portion 25" as shown in FIG. 3.

In FIG. 3, the Y-direction is used to mean the direction in which the medium 34 is fed (i.e., length). The X-direction is used to mean the direction of the width of the medium 34 or each rib 20. The Z-direction is used to mean the direction in which the ribs 20 protrude from the base portion 25 (i.e., height). Each rib 20 extends in a plane parallel to the YZ-plane. The feeding path of the medium 34 is defined by tips of the ribs 20.

Figure 4:
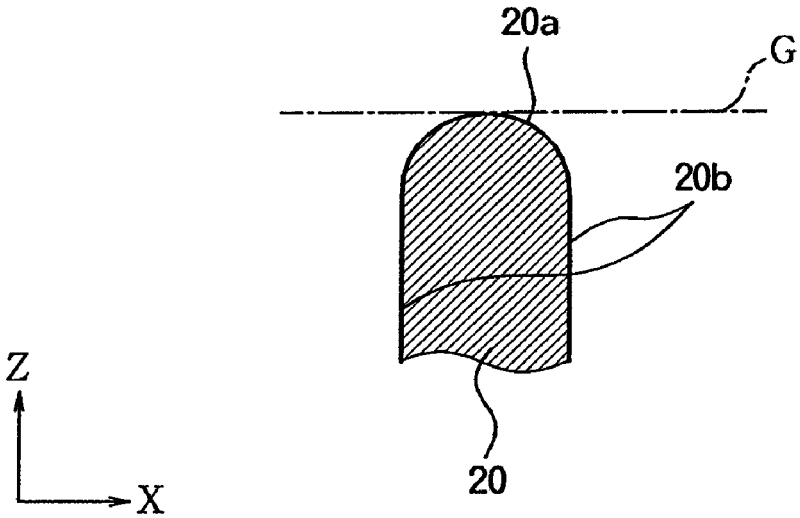
FIG. 4 is an enlarged cross sectional view of a rib of a guide member according to the first embodiment of the present invention.

FIG. 4 is a cross sectional view in the XZ-plane of the tip (i.e., an end side) of the rib 20. FIG. 4 corresponds to the cross section taken along a plane IV in FIG. 3. Each rib 20 has a convex portion 20*a* at the tip thereof. The convex portion 20*a* has a curved surface that forms an upward convex curve in the XZ-plane. Two side surfaces 20*b* of each rib 20 in the X-direction (i.e., the width direction) are plane surfaces substantially in parallel to the YZ-plane. The medium 34 (FIG. 3) is fed in the Y-direction in such a manner that the medium 34 contacts the apexes of the convex portions 20*a*. In other words, the apexes of the convex portions 20*a* define a feeding surface G for guiding the medium 34.

Figure 5:
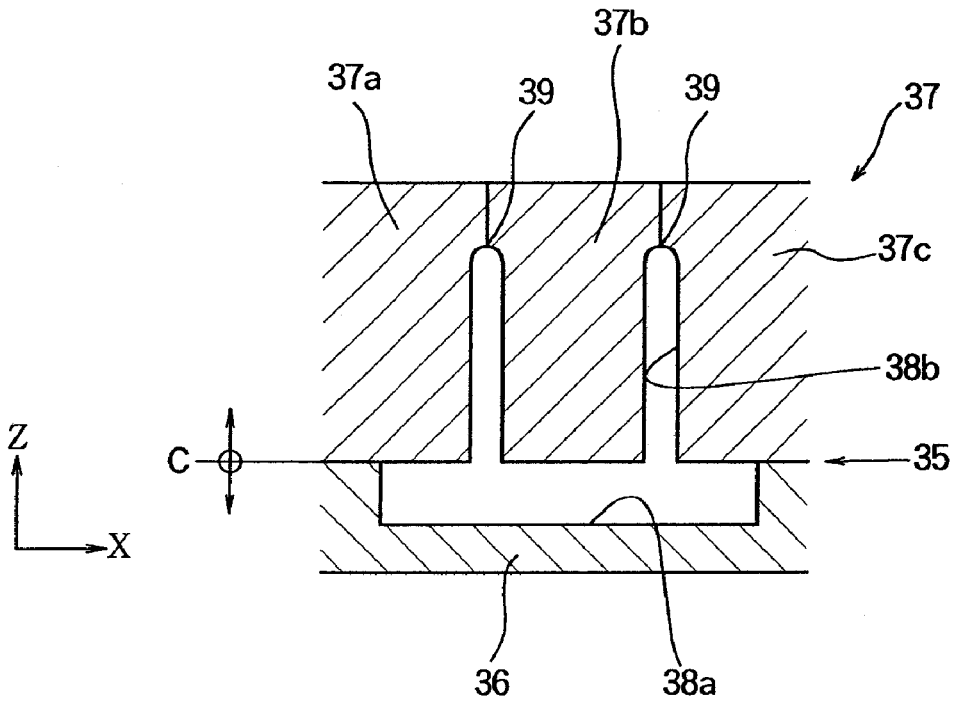
FIG. 5 is a cross sectional view of a mold used in a manufacturing process according to the first embodiment.

The manufacturing process of the guide member 18 (FIG. 3) will be described. FIG. 5 is a cross sectional view of a mold 37 used in the manufacturing process of the guide member 18. The mold 37 has a cavity 38*a* for forming the base portion 25 (FIG. 3) and cavities 38*b* for forming the ribs 20. The mold 37 can split into a plurality of mold components 37*a*, 37*b* and 37*c* at parting surfaces 39. Each parting surface 39 is aligned with the tip (i.e., the convex portion 20*a*) of the rib 20, and extends in parallel to the YZ-plane. The mold 37 further includes another mold component 36 at the cavity 38*a* side. The mold component 36 can be separated from the mold components 37*a*, 37*b* and 37*c* at a parting surface 35 that extends in parallel to the XY-plane.

Figure 6:
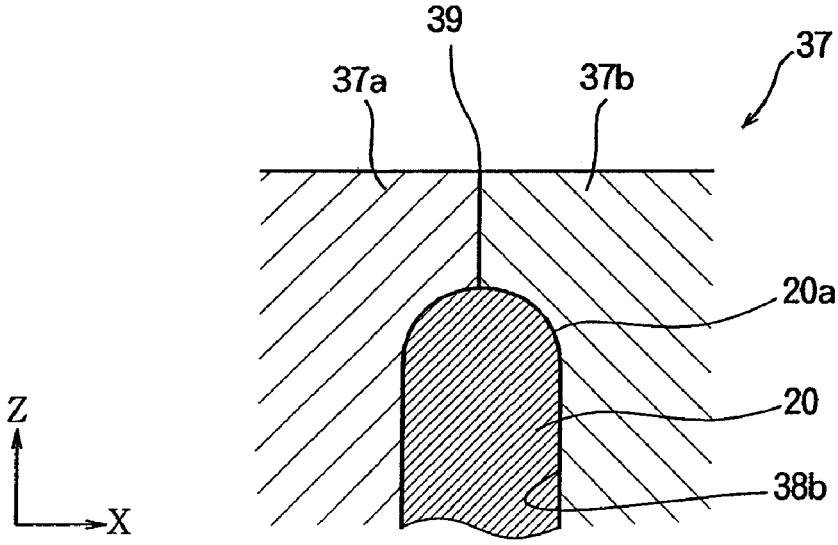
FIG. 6 is an enlarged cross sectional view of the mold filled with a resin in the manufacturing process of the first embodiment.

FIG. 6 is an enlarged cross sectional view of the mold 37 in the vicinity of the parting surface 39. In a preferred example, the parting surface 39 is aligned with the apex of the convex portion 20*a* (i.e., the center of the convex portion 20*a* in the X-direction). The gap formed at the parting surface 39 is, for example, from 0.01 to 0.02 mm. The mold 37 is made of, for example, an aluminum, a pre-hardened steel, or a quenching and tempering steel.

In the manufacturing process of the guide member 18 (FIG. 3), the mold components 36, 37*a*, 37*b* and 37*c* are assembled into the mold 37 as shown in FIG. 5. Then, molten resin is injected into the cavities 38*a* and 38*b* via a not-shown nozzle. The resin is made of engineering plastic such as xylon (R) (modified polyphenylene ether), ABS (acrylonitrile-butadien-styrene), or ABS/PS (the mixture of ABS and PS). The injected resin flows toward the tips of the cavities 38*b*. In the tips of the cavities 38*b*, the air (or other gas that generates in the mold 37) escapes outside through the gap formed at the parting surface 39, and therefore the resin can be sufficiently filled in the cavities 38*b*. Then, the mold 37 is cooled. Further, the mold component 36 is separated from the mold components 37*a*, 37*b* and 37*c* at the parting surface 35 in the direction denoted by C in FIG. 5, and a molded piece is taken out of the mold 37.

Figure 7A:
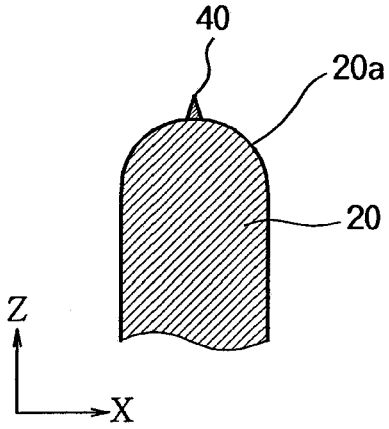
FIGS. 7A and 7B are respectively a cross sectional view and a side view of a burr formed on the rib in the manufacturing process of the first embodiment.
Figure 7B:
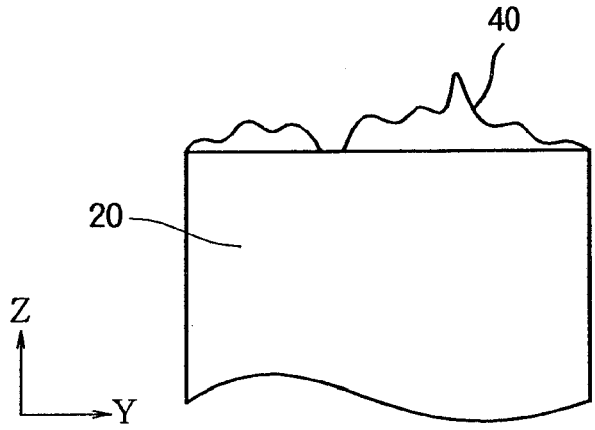
Figure 8:
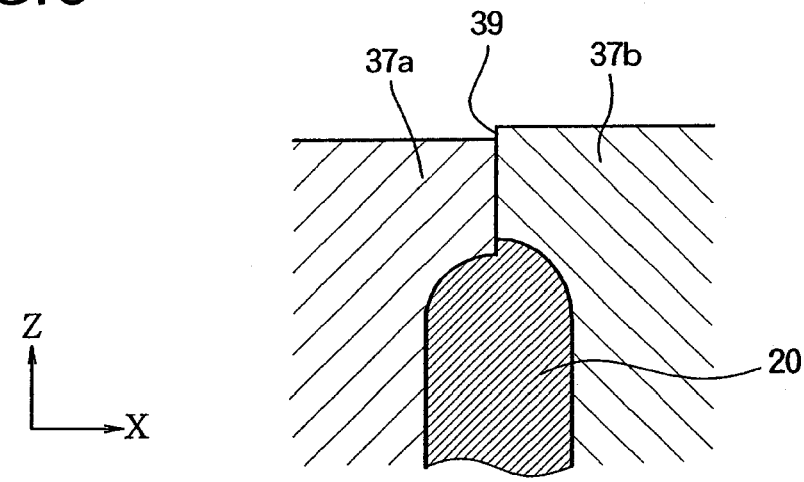
FIG. 8 is a schematic cross sectional view of the mold in a state where mold components are not properly aligned with each other.
Figure 9:
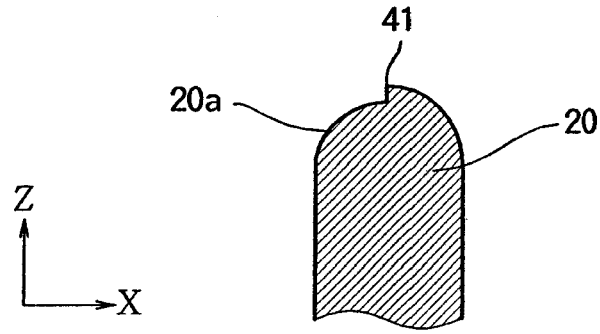
FIG. 9 is a cross sectional view of the rib with a step portion formed by the misalignment of the mold components as shown in FIG. 8.

FIGS. 7A and 7B are respectively a cross sectional view in the XZ-plane and a side view of the tip of the rib 20 of the molded piece taken out of the mold 37. As shown in FIGS. 7A and 7B, a burr 40 may be formed on the convex portion 20*a* of the rib 20. The burr 40 is formed by the resin entering into the gap formed at the parting surface 39 (FIG. 6). Further, if there is a difference in height between the adjacent mold components 37*a* and 37*b* as shown in FIG. 8, an edge portion 41 may be formed on the convex portion 20*a* of the rib 20 as schematically shown in FIG. 9. Therefore, a deburring operation is performed after the above described injection molding process, for removing the burr 40 (FIG. 7A) or the edge portion 41 (FIG. 9) so that the burr 40 or the edge portion 41 does not interfere with the feeding of the medium 34.

As described above, according to the first embodiment, as the mold 37 has the parting surface 39 aligned with the convex portion 20*a* of the rib 20, the air (or other gas generated in the mold 37) escapes outside through the gap formed at the parting surface 39 of the mold 37. Thus, the resin can sufficiently be filled in the cavity of the mold 37. As a result, even when the ribs 20 are high, the defective molding can be prevented.

Moreover, the machining (finishing, polishing or the like) of the mold 37 can be performed in a state where the mold 37 splits, and therefore the machining operation can be simplified.

Second Embodiment

Figure 10:
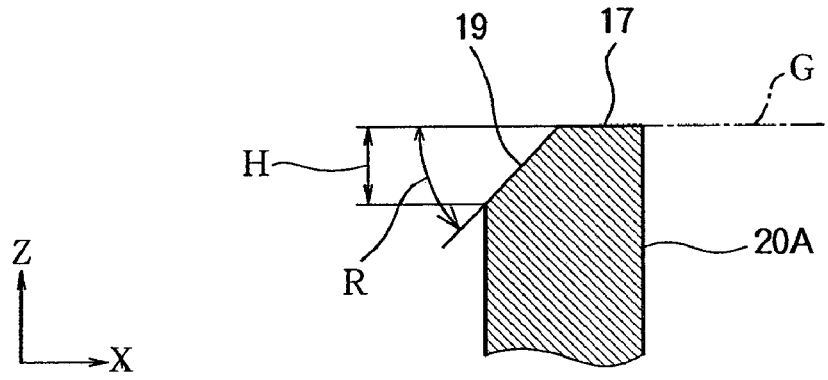
FIG. 10 is an enlarged cross sectional view of a rib of a medium feeding device according to the second embodiment.

FIG. 10 is an enlarged cross sectional view in the XZ-plane of a rib 20A of a guide member according to the second embodiment. FIG. 10 corresponds to the cross section taken along a plane IV in FIG. 3. The guide member of the second embodiment is different from the guide member 18 of the first embodiment (FIG. 4) in the shape of the tip of the rib 20A.

In this embodiment, the tip (i.e., an end side) of the rib 20A includes an end portion 17 that defines the feeding surface G for guiding the medium 34, and an inclined portion 19 that inclines downward from the end portion 17. The end portion 17 has a horizontal flat surface. The inclined portion 19 has an inclined flat surface. There is a predetermined difference H in height between the end portion 17 and the lower end (i.e., the farthest end from the end portion 17) of the inclined portion 19. As shown in FIG. 10, the inclined portion 19 is preferably provided on only one side of the end portion 17 in a widthwise direction of the rib. The width of the rib 20A (i.e., the dimension in the X-direction) is, for example, 1.2 mm. The width of the end portion 17 is, for example, 0.5 mm. The height (i.e., the dimension in the Z-direction) of the rib 20A from the base portion 25 is, for example, 36 mm. The inclination angle R of the inclined portion 19 with respect to the feeding surface G is preferably less than or equal to 45 degrees.

Figure 11:
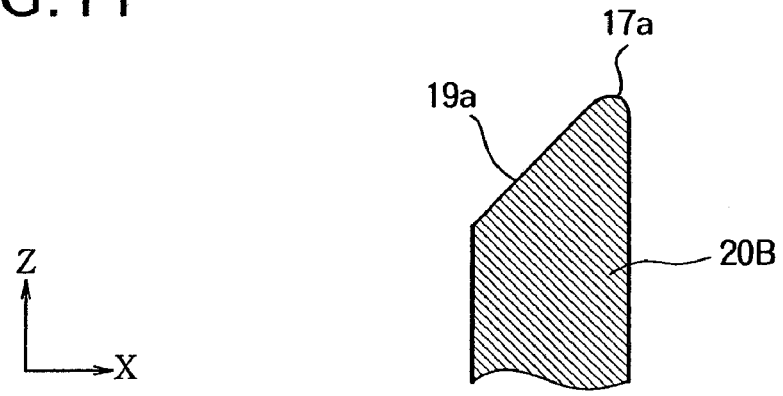
FIG. 11 is an enlarged cross sectional view of another example of the rib according to the second embodiment.

FIG. 11 shows an alternative structure of the rib (referred to as a rib 20B). Although the end portion 17 of the rib 20A (FIG. 10) has a flat surface, an end portion 17*a* of the rib 20B (FIG. 11) has a curved surface that forms an upward convex curve in the XZ-plane. This rib 20B also includes an inclined portion 19*a* that inclines downward from the end portion 17*a*.

Figure 12:
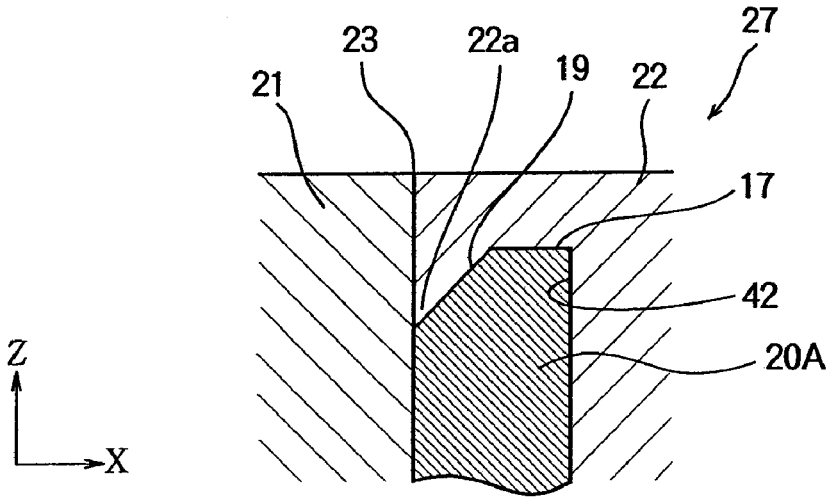
FIG. 12 is an enlarged cross sectional view of the mold filled with the resin in a manufacturing process of the second embodiment.

The manufacturing process of the guide member of the second embodiment will be described. FIG. 12 is a cross sectional view of a mold 27 used in the manufacturing process of the guide member of the second embodiment. The mold 27 has cavities 42 for forming the ribs 20A and a cavity 38*a* (FIG. 5) for forming the base portion 25 (FIG. 3). The mold 27 can split into a plurality of mold components 21 and 22 at parting surfaces 23 (only one parting surface 23 is shown in FIG. 12). The parting surface 23 is aligned with the lower end (i.e., the farthest end from the end portion 17) of the inclined portion 19, and extends in parallel to the YZ-plane. The material of the mold 37 and the gap formed at the parting surface are the same as those described in the first embodiment. Other structures of the mold 27 is the same as those of the mold 37 described in the first embodiment.

In the manufacturing process of the guide member, the mold components are assembled into the mold 27 as shown in FIG. 12. Then, molten resin is injected into the mold 27. The resin is made of the engineering plastic described in the first embodiment. The injected resin flows toward the tips of the cavities 42. In the tips of the cavities 42, the air (or other gas that generates in the mold 27) escapes outside through the gap formed at the parting surface 23, and therefore the resin can be sufficiently filled in the cavities 42. Then, the mold 27 is cooled, and the mold 27 splits as described in the first embodiment, so that a molded piece is taken out of the mold 27.

Figure 13:
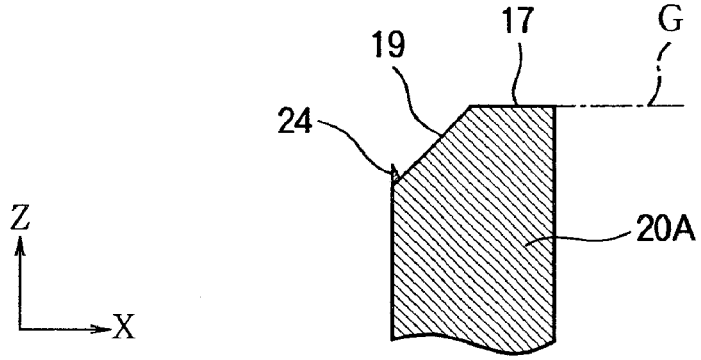
FIG. 13 is an enlarged cross sectional view of a burr formed on the rib in the manufacturing process of the second embodiment.

FIG. 13 is a cross sectional view in the XZ-plane of the tip of the rib 20A of the molded piece taken out of the mold 27. As shown in FIG. 13, a burr 24 may be formed on the lower end of the inclined portion 19. However, if the burr 24 does not reach the feeding surface G, it is not necessary to remove the burr 24, because the burr 24 does not interfere with the feeding of the medium 34. In a preferred example, the deburring operation is performed when the height of the burr 24 exceeds a predetermined height (for example, 0.2 mm). Alternatively, because the height of the burr 24 depends on the viscosity of the resin injected into the mold 27, it is also possible to adjust the viscosity of the resin so that the height of the burr 24 is less than the predetermined height. In the case where the rib 20B (FIG. 11) is formed instead of the rib 20A, the manufacturing process can be performed in a similar manner.

In the above described manufacturing process, since the inclination angle R of the inclined portion 19 with respect to the feeding surface G (i.e., the end portion 17) is less than or equal to 45 degrees, the angle of an acute-angle portion 22*a* of the mold component 22 between the inclined portion 19 and the parting surface 23 is relatively large. Thus, the damage of the acute-angle portion 22*a* can be restricted.

As described above, according to the second embodiment, as was described in the first embodiment, the air (or other gas generated in the mold 27) escapes outside through the gap formed at the parting surface 23 of the mold 27, and therefore the resin can sufficiently be filled in the cavity 42 of the mold 27. Therefore, the defective molding can be prevented, even when the ribs 20A are high. Additionally, the machining of the mold 37 can be performed in a state where the mold 37 splits, and therefore the machining operation can be simplified.

Moreover, according to the second embodiment, the parting surface 23 is aligned with the lower end of the inclined portion 19 of the rib 20A. Thus, if the height of the burr 40 is less than the predetermined height, the deburring operation can be eliminated, and therefore the manufacturing process can be simplified.

Third Embodiment

Figure 14:
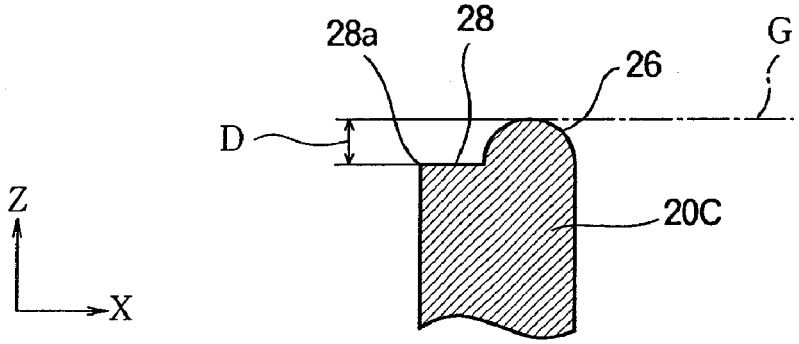
FIG. 14 is an enlarged cross sectional view of a rib of a medium feeding device according to the third embodiment.

FIG. 14 is an enlarged cross sectional view in the XZ-plane of a rib 20C of a guide member according to the third embodiment. FIG. 14 corresponds to the cross section taken along a plane IV in FIG. 3. The guide member of the third embodiment is different from the guide member 18 of the first embodiment (FIG. 4) in the shape of the tip of the rib 20C.

In this embodiment, the tip (i.e., an end side) of the rib 20C includes a convex portion 26 that defines the feeding surface G for guiding the medium 34, and a step portion 28 adjacent to the convex portion 26. The convex portion 26 has a curved surface that forms an upward convex curve in the XZ-plane. The apex of the convex portion 26 defines the feeding surface G for guiding the medium 34. The step portion 18 has a flat surface substantially in parallel to the feeding surface G. There is a predetermined difference D in height (i.e., level difference) between the apex of the convex portion 26 and the step portion 18. In other words, the step portion 18 is distant from the feeding surface G. The width (i.e., the dimension in X-direction) of the rib 20C is, for example, 1.2 mm. The width of the step portion 28 is, for example, 0.4 mm. The convex portion 26 has a cross section of a semi-circle whose radius is 0.4 mm. The difference D in height between the convex portion 26 and the step portion 28 is, for example, 0.4 mm.

Figure 15:
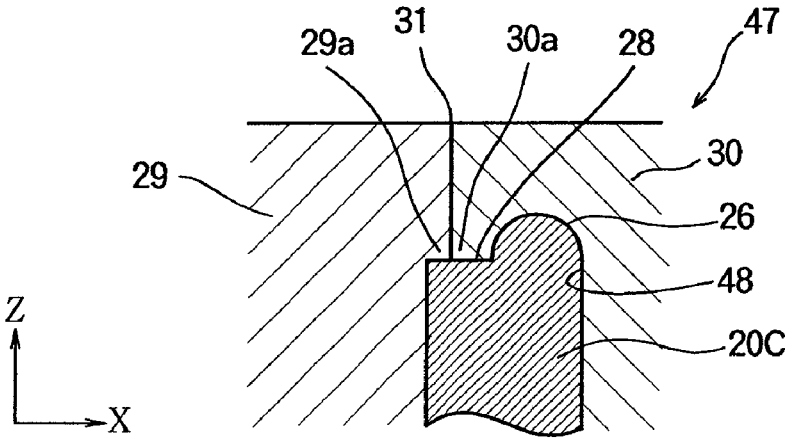
FIG. 15 is an enlarged cross sectional view of the mold filled with the resin in a manufacturing process of the third embodiment.

The manufacturing process of the guide member of the third embodiment will be described. FIG. 15 is a cross sectional view of a mold 47 used in the manufacturing process of the guide member of the third embodiment. The mold 47 has cavities 48 for forming the ribs 20C and the cavity 38*a* (FIG. 5) for forming the base portion 25 (FIG. 3). The mold 47 can splits into a plurality of mold components 29 and 30 at parting surfaces 31 (only one parting surface 31 is shown in FIG. 15). The parting surface 31 is aligned with the step portion 28. The material of the mold 47 and the gap formed at the parting surface 31 are the same as those described in the first embodiment. Other structures of the mold 47 is the same as those of the mold 37 described in the first embodiment.

Due to the above described structure of the mold 47, opposing parts 29*a* and 30*a* of the mold components 29 and 30 on both sides of the parting surface 31 have shapes with rectangular corners, and therefore the strength of the opposing parts 29*a* and 30*a* can be increased.

Figure 16:
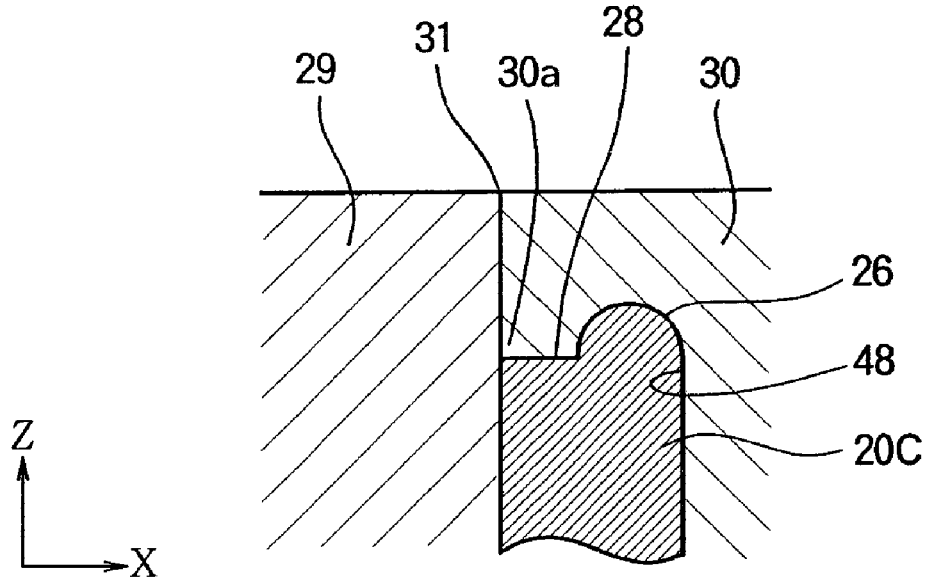
FIG. 16 is an enlarged cross sectional view of another example of the mold used in the manufacturing process of the third embodiment.

FIG. 16 shows an alternative structure of the mold 47. As shown in FIG. 16, the parting surface 31 is aligned with the farthest end of the step portion 28 from the convex portion 26. With such a structure, the mold component 29 has no step portion at the parting surface 31 side thereof, and the width of the above described part 30*a* can be widened, with the result that the strength of the mold components 29 and 30 can be increased.

In the manufacturing process of the guide member, the mold components are assembled into the mold 47 as shown in FIG. 15. Then, molten resin is injected into the mold 47. The resin is made of the engineering plastic described in the first embodiment. The injected resin flows toward the tips of the cavities 48. In the tips of the cavities 48, the air (or other gas that generates in the mold 47) escapes outside through the gap formed at the parting surface 31, and therefore the resin can be sufficiently filled in the cavities 48. Then, the mold 47 is cooled, and the mold 47 splits as described in the first embodiment, so that a molded piece is taken out of the mold 47.

Figure 17:
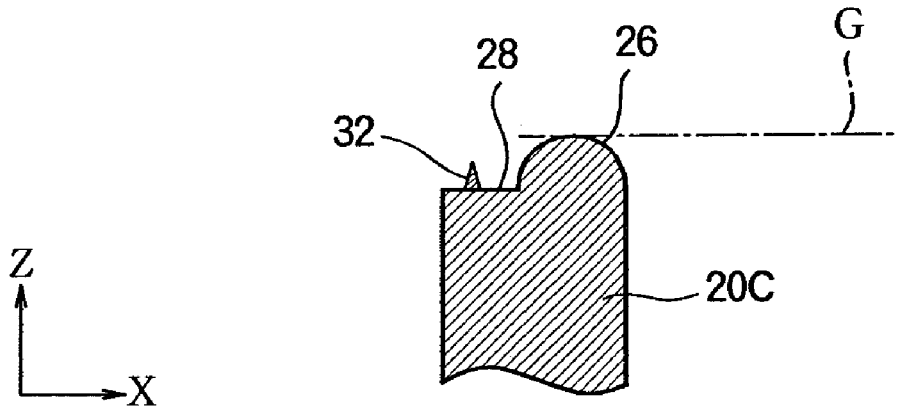
FIG. 17 is a cross sectional view of a burr formed on the rib in the manufacturing process of the third embodiment.

FIG. 17 is a cross sectional view in the XZ-plane of the tip of the rib 20C of the molded piece taken out of the mold 47. As shown in FIG. 17, a burr 32 may be formed on the step portion 28. However, if the burr 32 does not reach the feeding surface G, it is not necessary to remove the burr 32 because the burr 32 does not interfere with the feeding of the medium 34. In a preferred example, the deburring operation is performed when the height of the burr 32 exceeds a predetermined height. Further, because the height of the burr 32 depends on the viscosity of the resin injected into the mold 47, it is also possible to adjust the viscosity of the resin so that the height of the burr 32 is less than the predetermined height. In the case where the mold of FIG. 16 is used instead of mold 47, the manufacturing process can be performed in a similar manner.

As described above, according to the third embodiment, as was described in the first embodiment, the air (or other gas generated in the mold) escapes through the gap formed at the parting surface 31 of the mold 47, and therefore the resin can sufficiently be filled in the cavity of the mold 47, with the result that the defective molding can be prevented even when the ribs 20C are high. Additionally, the machining of the mold 37 can be performed in a state where the mold 37 splits, and therefore the machining operation can be simplified.

Further, according to the third embodiment, because the parting surface 31 is aligned with the step portion 28 (or the farthest end of the step portion 28 from the end portion 17), the deburring operation can be eliminated if the height of the burr 41 is less than the predetermined height, and therefore the manufacturing process can be simplified.

Moreover, according to the third embodiment, because the opposing parts 29*a* and 39*a* of the mold components 29 and 30 have shapes with rectangular corners, the parts 29*a* and 30*a* can be strengthen, and therefore the lifetime of the mold 47 can be enhanced.

Additionally, the ribs 20C contact the medium 34 at the apexes of the convex portions 26, and therefore the friction between the medium 34 and the ribs 20*a* decreases.

The guide member and the medium feeding device described in the first through third embodiments can be employed in an apparatus (for example, a scanner, a facsimile, a photocopier) in which a medium is fed, and is not limited to the image forming apparatus shown in FIG. 1.

Further, the medium feeding device of the present invention is not limited to a device that feeds the medium by the feeding roller 3 or the like as shown in FIG. 1, but can be any device that has at least one rib disposed on a medium feeding path.

In the example shown in FIG. 3, the guide member 18 has a plurality of ribs 20 formed on the base portion 25. However, the present invention is not limited to such a structure. For example, it is possible that the guide member 18 has no base portion 25. Further, it is possible to provide a single rib 20 for guiding the medium 34.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A medium feeding device comprising:

a base;

a plurality of spaced-apart ribs contacting a bottom surface of a medium, each rib protruding from said base and defining a feeding path along which the medium is fed, each rib having a length measured in a direction along which the medium is fed, each rib having a width measured in a direction perpendicular to the length, each rib having a height measured in a direction perpendicular to both the length and the width, the length of each rib being greater than the height of each rib, each rib having two sidewalls opposing each other in the widthwise direction of each rib, each rib being entirely disposed within a width of the medium and entirely below the medium when the medium is fed along the feeding path, wherein, in a cross section perpendicular to a direction in which said medium is fed along said feeding path, a tip of each rib comprises:

an end portion that guides said medium; and an inclined portion provided on only one side of said end portion in the widthwise direction of said rib, said inclined portion extending from said end portion to one of said sidewalls so that said medium contacts the end portion of the rib and not the inclined portion, a projection being located on said inclined portion, a top surface of said projection being located below said end portion of said rib.

2. The medium feeding device according to claim 1, wherein the inclination angle of said inclined portion with respect to a feeding surface is less than or equal to 45 degrees.

3. The medium feeding device according to claim 1, wherein said end portion has a flat surface or a curved surface.

4. The medium feeding device according to claim 1, wherein said rib is formed by means of a mold which can split into a plurality of components at a parting surface, and said parting surface is aligned with the farthest end of said inclined portion from said end portion.

5. The medium feeding device according to claim 1, wherein said base is a frame provided substantially parallel to a surface of said medium to be fed, wherein said rib extends substantially perpendicularly from said frame and defines said feeding path along which said medium is fed, wherein said rib includes an extending portion that extends substantially perpendicularly from said frame, wherein said end portion is disposed on a distal end of said extending portion opposite to said frame.

6. The medium feeding device according to claim 5, wherein said end portion is a flat end surface disposed on said distal end of said extending portion, and wherein said inclined portion extends from said flat end surface to a side surface of said extending portion.

7. The medium feeding device according to claim 5, wherein said end portion is a curved end surface disposed on said distal end of said extending portion, and wherein said inclined portion extends from said curved end surface to a side surface of said extending portion.

8. The medium feeding device according to claim 1, wherein the projection is integrally molded with the inclined portion.

9. A guide member provided in a medium feeding device, said guide member comprising:

a base, a plurality of spaced-apart ribs contacting a bottom surface of a medium, each rib protruding from said base and defining a feeding path along which the medium is fed, each rib having a length measured in a direction along which the medium is fed, each rib having a width measured in a direction perpendicular to the length, each rib having a height measured in a direction perpendicular to both the length and the width, the length of each rib being greater than the height of each rib, each rib having two sidewalls opposing each other in the widthwise direction of each rib, each rib being entirely disposed within a width of the medium and entirely below the medium when the medium is fed along the feeding path, wherein, in a cross section perpendicular to a direction in which said medium is fed along said feeding path, a tip of each rib comprises:

an end portion that guides said medium; and an inclined portion provided on only one side of said end portion in the widthwise direction of said rib, said inclined portion extending from said end portion to one of said sidewalls so that the medium contacts the end portion of the rib and not the inclined portion, a projection being located on said inclined portion, a top surface of said projection being located below said end portion of said rib.

10. The guide member according to claim 9, wherein the projection is integrally molded with the inclined portion.

11. A medium feeding device comprising:

a base;

at least three spaced-apart ribs contacting a bottom surface of a medium, said at least three ribs being arranged in a widthwise direction of the medium, wherein each of said ribs protrudes from said base and defines a feeding path along which a medium is fed, each rib having a length measured in a direction along which the medium is fed, each rib having a width measured in a direction perpendicular to the length, each rib having a height measured in a direction perpendicular to both the length and the width, the length of each rib being greater than the height of each rib, each rib having two sidewalls opposing each other in the widthwise direction of each rib, wherein, in a cross section perpendicular to a direction in which said medium is fed along said feeding path, a tip of each rib comprises:

an end portion that guides said medium; and an inclined portion provided on only one side of said end portion in the widthwise direction of said rib, said inclined portion extending from said end portion to one of said sidewalls so that said medium contacts the end portion of the rib and not the inclined portion, a projection being located on said inclined portion, a top surface of said projection being located below said end portion of said rib.

* * * * *